US006819047B2

(12) United States Patent
Niimi

(10) Patent No.: US 6,819,047 B2
(45) Date of Patent: Nov. 16, 2004

(54) HIGH PRESSURE DISCHARGE LAMPS, AND ASSEMBLIES AND DISCHARGE VESSELS THEREFOR

(75) Inventor: Norikazu Niimi, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/336,744

(22) Filed: Jan. 6, 2003

(65) Prior Publication Data

US 2003/0137246 A1 Jul. 24, 2003

(30) Foreign Application Priority Data

Jan. 21, 2002 (JP) ..... 2002-011970

(51) Int. Cl.[7] ..... H01J 17/18
(52) U.S. Cl. ..... 313/623; 313/624; 313/625
(58) Field of Search ..... 313/623, 624, 313/625, 332, 290

(56) References Cited

U.S. PATENT DOCUMENTS 4,780,646 A * 10/1988 Lange ..... 313/623
5,304,892 A * 4/1994 Lewandowski et al. ..... 313/623
5,424,608 A 6/1995 Juengst et al.
5,424,609 A * 6/1995 Geven et al. ..... 313/623
5,552,670 A 9/1996 Heider et al.
6,169,366 B1 * 1/2001 Niimi ..... 313/633
6,433,479 B1 * 8/2002 Higashimoto et al. ..... 313/623
6,573,656 B2 * 6/2003 Kaneko et al. ..... 313/623
2002/0033670 A1 3/2002 Niimi
2002/0033671 A1 3/2002 Niimi

FOREIGN PATENT DOCUMENTS

EP 0 982 278 A1 3/2000
JP A 2001-58882 3/2001

* cited by examiner

*Primary Examiner*—Ashok Patel
(74) *Attorney, Agent, or Firm*—Oliff & Berridge PLC

(57) ABSTRACT

A ceramic discharge vessel having end portions and an inner space formed therein is filled with an ionizable light emitting substance and a starter gas. The end portion has an inner wall surface facing an opening formed in the end portion. A hollow portion is formed in the conductive member. The conductive member is inserted into the opening of the end portion of the vessel. A joining layer joins the inner wall surface of the end portion and the outer surface of the conductive member. A recess facing the opening is formed in the end portion, and the recess extends circumferentially with respect to the central axis "X" of the vessel. When the conductive member is inserted into the opening of the end portion of the vessel and joined, the adherence or residue of joining material onto the end face or inner surface of the conductive member may be prevented.

17 Claims, 12 Drawing Sheets

HIGH PRESSURE DISCHARGE LAMPS, AND ASSEMBLIES AND DISCHARGE VESSELS THEREFOR

This application claims the benefit of Japanese Patent Application P2002-11, 970, filed on Jan. 21, 2002, the entirety of which is incorporated by reference.

BACKGROUND OF THE INVENTION

1. Field of the Invention

The present invention relates to a high pressure discharge lamp and an assembly and discharge vessel therefor.

2. Description of the Related Art

A high pressure discharge lamp has a ceramic discharge vessel with two end portions. Sealing members (usually referred to as a ceramic plug) are inserted, respectively, to seal the respective end portions. A through hole is formed in each sealing member. A metal member with an electrode system is inserted in the through hole. An ionizable light-emitting material is introduced and sealed in the inner space of the discharge vessel. Known high pressure discharge lamps include a high pressure sodium vapor and metal halide lamp, the latter exhibiting more superior color coordination. The lamp may be used in high temperature condition by forming the discharge vessel with a ceramic material.

In such discharge lamp, it is necessary to air-tightly seal between the end portion of the ceramic discharge vessel and a member for supporting an electrode system. The ceramic discharge vessel has a main body with a shape of a tube with two narrow ends, or a barrel, or a straight tube. The discharge vessel is made of for example, an alumina sintered body.

A Japanese patent application No. 178,415/1999 (EP 0982278, A1) discloses the following structure. A joining portion is provided between the end portion of a ceramic discharge vessel and a member for supporting an electrode system. The joining portion has joining material contacting the discharge vessel and an intermediate glass layer contacting the supporting member and existing between the supporting member and the joining material. The joining material is composed of a porous bone structure with open pores and made of a sintered product of metal powder. The joining material further has glass phase impregnated into the open pores in the bone structure. Herewith, such joined body has improved air-tightness and resistance against corrosion, so that thermal cycles does not result in the fracture of the joined body.

SUMMARY OF THE INVENTION

When the joined structure described above is produced, a porous bone structure is formed on the outer surface of a metal tube made of, for example, molybdenum and the metal tube is then inserted into an opening formed in an end portion of a ceramic discharge vessel. A clearance is formed between the porous bone structure and the inner surface of the vessel. Molten glass is then flown into the clearance and then solidified. The thus produced joined structure has improved air-tightness and resistance against cycles of turning ons and offs.

The inventor has found the following problems in the mass production process of the joined structure. That is, the molten glass may be adhered onto the end face or inner surface of the metal tube and solidified. In this case, the solidified glass may prevent the insertion and fixing of a supporting rod for an electrode into the inner space of the metal tube, so that the production yield may be reduced.

The object of the present invention is to provide a novel high pressure discharge lamp utilizing a ceramic discharge vessel and a conductive member inserted into the opening of the end portion of the vessel, so that the adherence of a joining material onto the end face or inner surface of the conductive member may be prevented.

The present invention provides an assembly for a high pressure discharge lamp. The assembly has a ceramic discharge vessel having end portions and an inner space formed therein to be filled with an ionizable light emitting substance and a starter gas, and the end portion has an inner wall surface facing an opening formed in the end portion. The assembly further has a conductive member having an outer surface and inner surface facing a hollow portion formed therein. The conductive member is inserted in the opening, and a joining layer joins the inner wall surface of the end portion and the outer surface of the conductive member. A recess facing the opening is formed in the end portion, and the recess extends circumferentially with respect to the central axis of the vessel.

The present invention further provides a high pressure discharge lamp having the assembly and an electrode system fixed in the inner space of the vessel.

The present invention further provides a ceramic discharge vessel for a high pressure discharge lamp. The vessel has end portions and an inner space formed therein to be filled with an ionizable light emitting substance and a starter gas. The end portion has an inner wall surface facing an opening formed in the end portion. A recess facing the opening is formed in the end portion and extends circumferentially with respect to the central axis of the vessel.

The inventor has studied the cause of the adhesion 25, 26 (see FIG. 7) of joining material onto the end face 6*d* and inner surface 6*e* of a conductive member 6. The inventor has reached the following discovery. That is, molten joining material is flown onto the inner surface 2*b* of an end portion 2 of a ceramic discharge vessel 1. The molten material tends to wet the end face 6*d* and inner surface 6*e* of the conductive member 6, before wetting the inner wall surface 2*b* of the end portion of the vessel 1. Furthermore, the molten material may be easily absorbed toward the inner space 5 through a clearance between the outer surface 6*a* of the member 6 and the inner wall surface 2*b* of the end portion 2 by means of capillary phenomenon.

Based on the above discovery, the inventor has tried to form a recess 3 extending circumferentially with respect to the central axis "X" of the vessel 1 on the inner wall surface 2*b* facing an opening 32 of the end portion 2. When molten joining material is flown into a clearance between the outer surface of the member 6 and inner wall surface 2*b* of the end portion 2, it is thereby possible to prevent the absorption due to the capillary phenomenon. It is further possible to absorb excess joining material into the recess and to prevent the wetting of the end face and inner surface of the conductive member with the molten joining material.

The effects, features and advantages of the invention will be appreciated upon reading the following description of the invention when taken in conjunction with the attached drawings, with the understanding that some modifications, variations and changes of the same could be made by the skilled person in the art.

DESCRIPTION OF THE PREFERRED EMBODIMENTS

Figure 1:
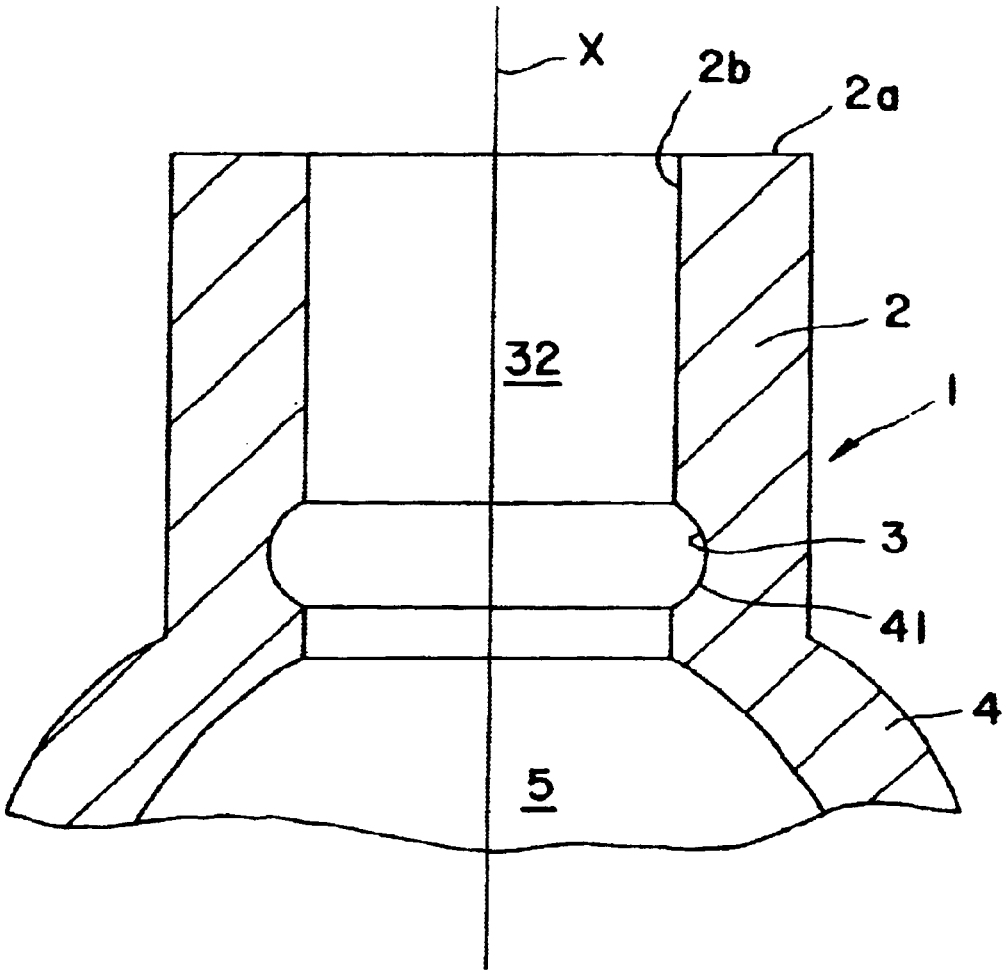
FIG. 1 is a longitudinal sectional view schematically showing an end portion 2 of a ceramic discharge vessel 1.

The present invention will be described further in detail referring to the attached drawings. As shown in FIG. 1, a ceramic discharge vessel 1 has a main portion 4 having a shape of barrel and a pair of end portions 2 provided at both ends of the main portion 4. 2*a* and 2*b* represent an end face and inner wall surface of the end portion 2, respectively. The inner wall surface 2*b* extends straightforwardly in the direction of the central axis "X" of the vessel 1. The end portion 2 has an opening 32 communicating with an inner space 5 of the main portion 4. A recess 3 is formed on the inner wall surface 2*b* of the end portion 2 and extends circumferentially with respect to the central axis "X". In the present example, the profile 41 of the recess 3 is substantially arc-shaped in a longitudinal section (in a section as shown in FIG. 1).

Figure 2:
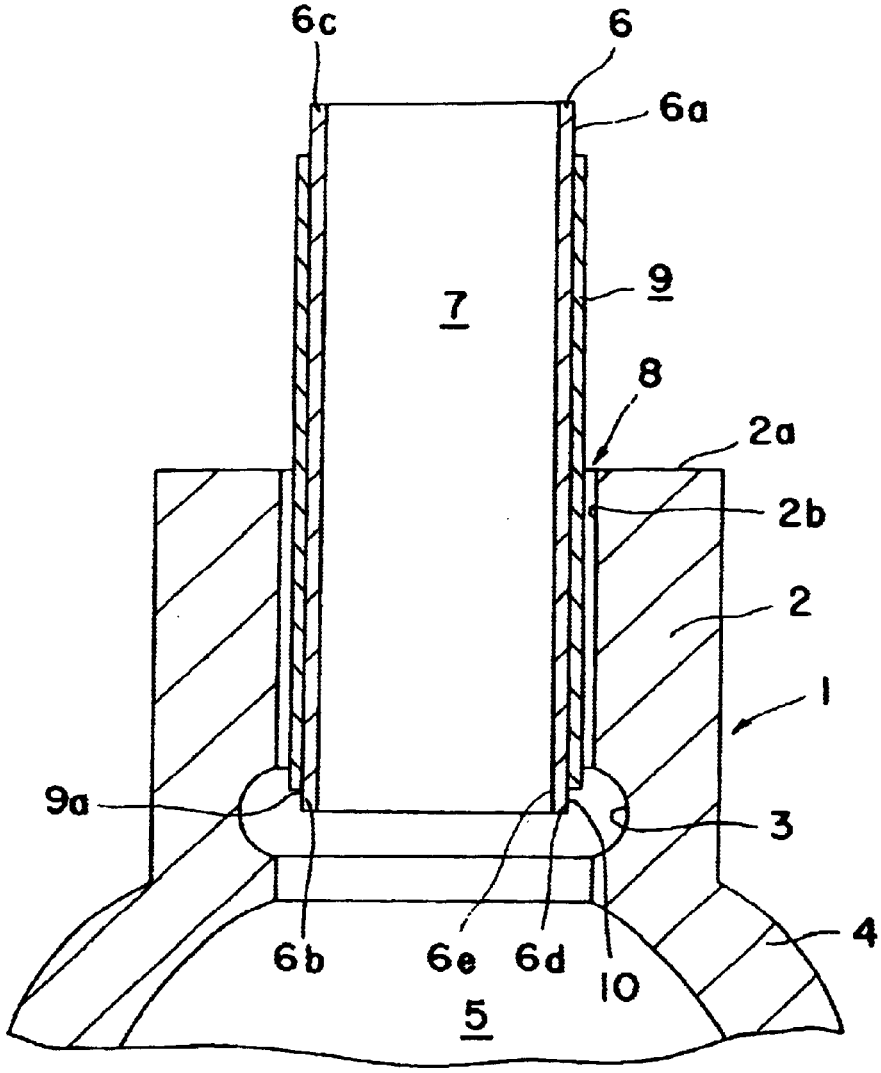
FIG. 2 shows a conductive member 6 inserted into the end portion 2 of the vessel 1 and a porous bone structure 9 formed on the outer surface 6*a* of the conductive member 6.
Figure 3:
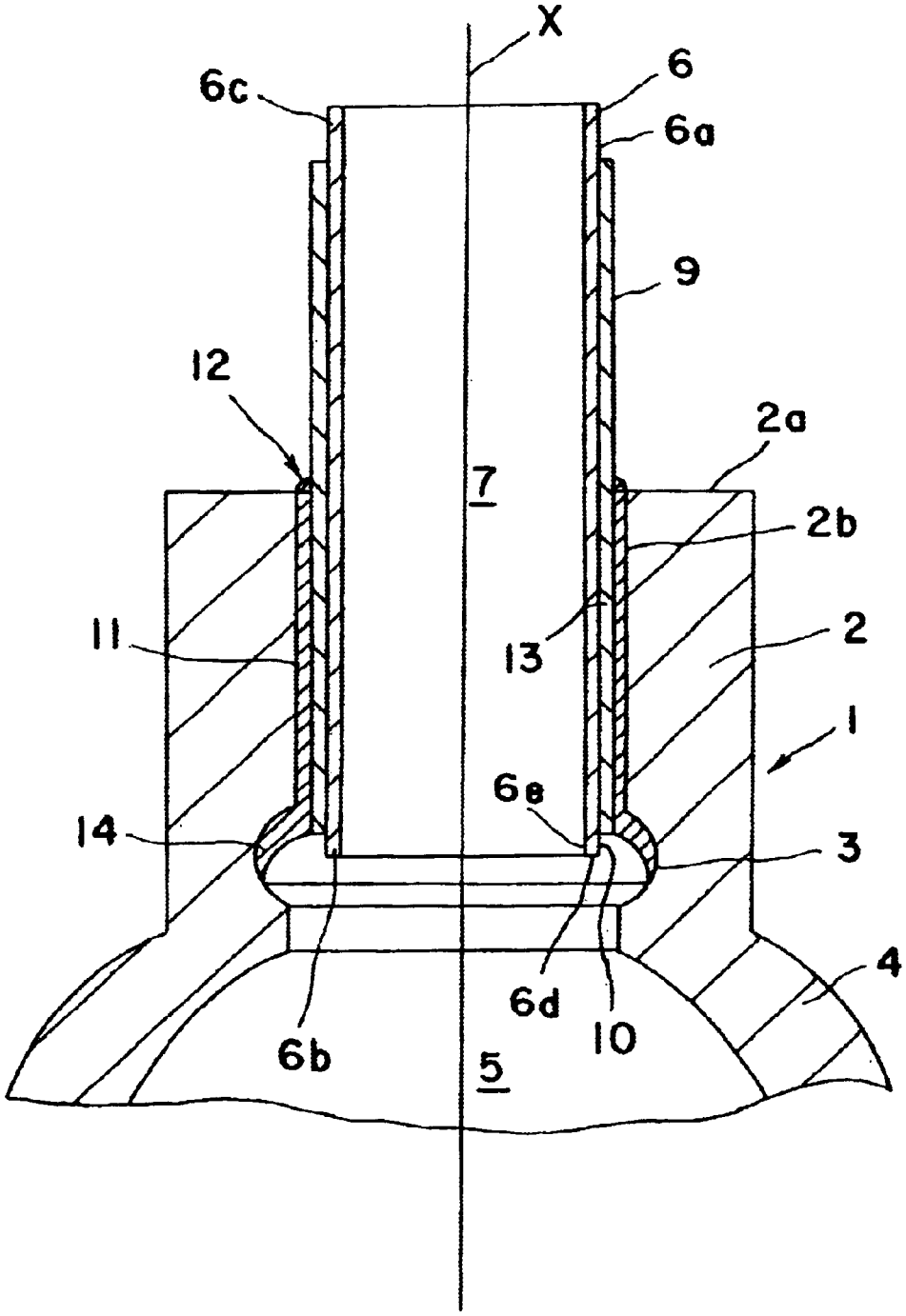
FIG. 3 shows the end portion 2 of the vessel 1, conductive member 6 and a joining layer 12 joining them.

In the present example, a conductive member 6 has a shape of a tube and an hollow portion 7 is formed therein, as shown in FIG. 2. The hollow portion 7 is to be sealed after introducing a starter gas and an ionizable light-emitting substance in the vessel 1. 6*a* represents an outer surface, 6*c* represents an outer end part, 6*b* represents an inner end part, 6*d* represents an end face and 6*e* represents an inner surface of the conductive member 6. A porous bone structure 9 is provided on the outer surface of the conductive member 6 and the member 6 is then inserted into the end portion 2. At this stage, a specific clearance 8 is provided between the bone structure 9 and the inner wall surface 2*b* of the end portion 2. The end face 6*d* of the member 6 is positioned inside of the recess 3. The preferred relative position of the member 6 and recess 3 will be described later. 9*a* represents an inner end of the bone structure 9. In the present example, a part of the conductive member 6 is not covered with the structure 9 to provide an exposed region 10 between the end part 9*a* and end face 6*d*.

At this stage, a glass or ceramic composition is then molten and flown into the clearance 8. The glass or ceramic composition may be powder or a shaped body of powder or shaped body containing powder and a binder. The molten composition is flown into the clearance 8 to generate an intermediate layer 11 composed of a glass (including crystallized glass) or a ceramic. The molten composition penetrates into open pores of the bone structure 9 to generate the impregnated phase at the same time. As a result, an inner layer 13 is formed having the bone structure composed of a sintered product of metal powder and the impregnated phase impregnated into the open pores. The inner and intermediate layers 11, 13 together form a joining layer 12 of the conductive member 6 and end portion 2. The impregnated phase is composed of a material substantially same as that of the intermediate layer, that is a glass or ceramics. A part of the molten material wets the inner wall surface of the recess 3 and forms a solidified layer 14 in the recess 3. The recess 3 drives the flow of the molten material along the inner wall surface of the recess to prevent the wetting of the end face 6*d* of the conductive member 6.

Figure 7:
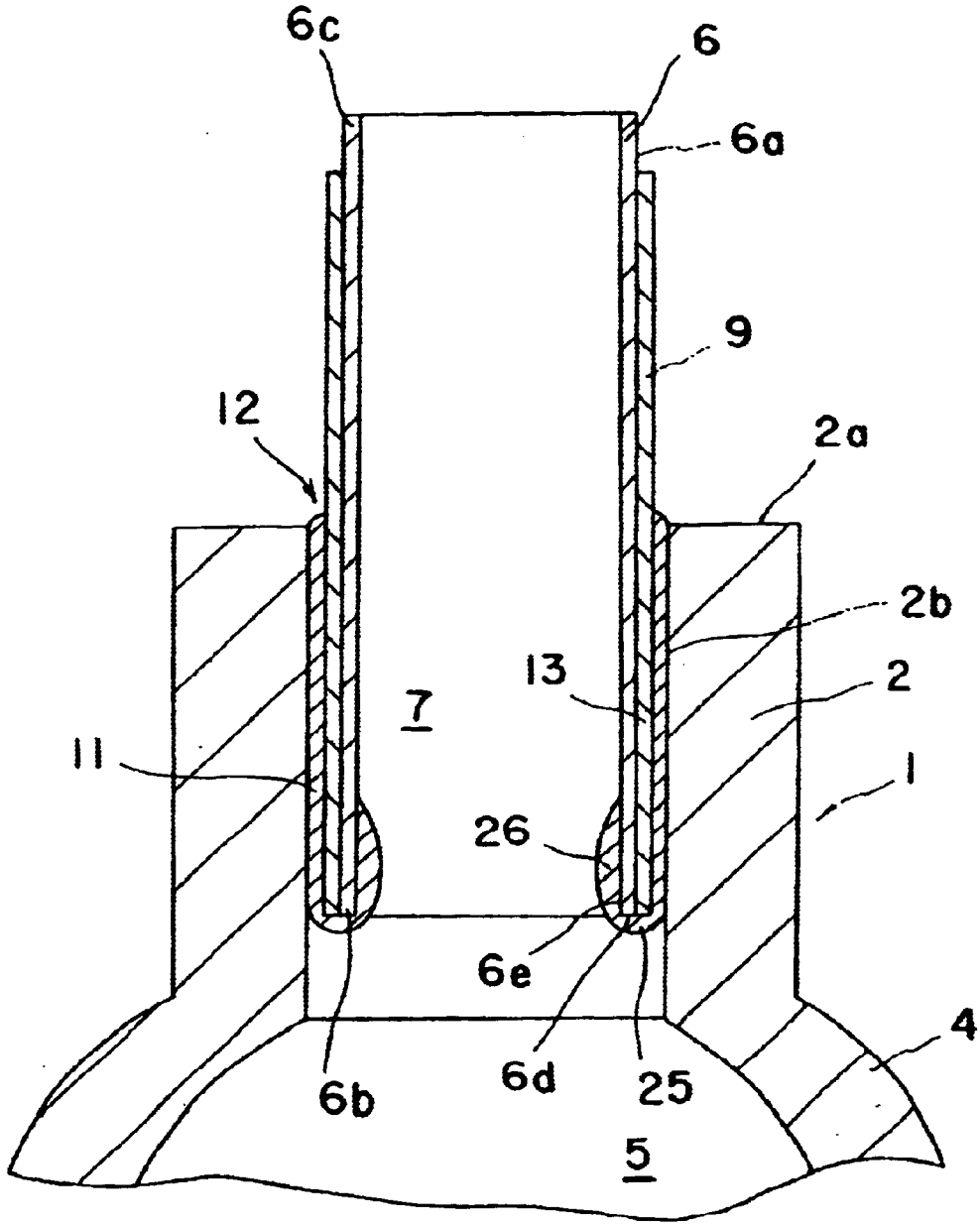
FIG. 7 shows an example of a structure of the end portion 2 of the vessel 1 without the recess.

For example, when the recess 3 is not provided on the inner wall surface 2*b* of the end portion 2 as shown in FIG. 7, the molten material tends to be absorbed along the surface of the bone structure 9 to wet the end face 6*d* and inner surface 6*e* of the conductive member 6. This is because the surface of the metal bone structure 9 may be easily wetted with the molten material than the inner surface 2*b* of the discharge vessel made of a ceramic or glass.

A porous bone structure is made of a sintered product of metal powder. The metal powder may preferably be made of a metal selected from the group consisting of molybdenum, tungsten, rhenium, niobium, tantalum and the alloys thereof. For further improving the resistance of the structure against a halogen, a metal selected from the group consisting of molybdenum, tungsten, rhenium and the alloys thereof is particularly preferable.

The porous bone structure may preferably has a porosity, of open pores, of not lower than 16%, and more preferably not lower than 40%, thus improving the strength of the joining material. The porosity may preferably be not higher than 80%, and more preferably be not higher than 70%. It is thereby possible to effectively impregnate the ceramic or glass material into the open pores of the bone structure and to disperse the stress applied on the structure so that the resistance against thermal cycles may be improved.

The glass or ceramic composition constituting the intermediate layer and impregnated phase is not particularly limited. The composition may preferably be composed of one or more oxide(s) selected from the group consisting of $Al_2O_3$, $Sc_2O_3$, $Y_2O_3$, $La_2O_3$, $Gd_2O_3$, $Dy_2O_3$, $Ho_2O_3$, $Tm_2O_3$, $SiO_2$, $MoO_2$ and $MoO_3$. Particularly preferably, a mixure of two or more oxides is used. Further, eutectic compositions of two component system of $Dy_2O_3$—$Al_2O_3$ and $Sc_2O_3$—$Al_2O_3$ are preferable. The reason is that such eutectic compositions of two component systems have a substantially high melting point of about 1800° C.

Alternatively, the glass composition may preferably be as follows.

$Al_2O_3$; 10 to 30 weight percent, $SiO_2$; 15 to 40 weight percent, $Y_2O_3$; 0 to 40 weight percent, $Dy_2O_3$; 0 to 70 weight percent, $B_2O_3$; 0 to 5 weight percent, $MoO_3$; 0 to 10 weight percent.

The ceramic composition may preferably contain a metal oxide and at least one of a nitride and an oxynitride. Typically, the ceramic composition is a mixture of nitride powder and metal oxide powder, or, a mixture of oxynitride powder and metal oxide powder. In a preferred embodiment, the metal oxide constituting the ceramic composition contains a rare earth oxide.

The rare earth oxide is the oxide or oxides of one or more element selected from the group consisting of samarium, scandium, yttrium, lanthanum, cenium, praseodymium, neodymium, promethium, europium, gadolinium, terbium, dysprosium, holmium, erbium, thulium, ytterbium and rhutenium. Particularly preferably, one or more oxide(s) selected from the group consisting of $Sc_2O_3$, $Y_2O_3$, $La_2O_3$, $Gd_2O_3$, $Dy_2O_3$, $Ho_2O_3$ and $Tm_2O_3$.

In a preferred embodiment, the metal oxide includes alumina. It is thus possible to further improve the resistance of the joining material and intermediate layer against a corrosive substance.

The nitride may particularly preferably be aluminum nitride, boron nitride, silicon nitride, molybdenum nitride or tungsten nitride.

In a preferred embodiment, the oxynitride includes aluminum oxynitride. The oxynitride of aluminum is generally a non-stoichiometric compound and may be represented by the formula $Al_{(64+x)/3}\square_{(8-X)/3}O_{32-x}N_x$ (□ represents vacancy). Typically x represents 5.

An inert gas, an ionizable light-emitting substance and optionally mercury may be introduced into the inner space of the discharge vessel. Alternatively, mercury is not contained and high pressure inert gas such as xenon gas may be used. The high pressure discharge lamp according to the present invention may be applied to not only a lamp for general lighting but also a head lamp for a vehicle.

The conductive member may preferably be a conductive ceramic or metal having corrosion resistance. Such metal may be made of one or more metal selected from the group consisting of molybdenum, tungsten, rhenium, niobium, tantalum and the alloys thereof.

Among them, niobium and tantalum have thermal expansion coefficients matching with those of ceramics, especially alumina ceramics, constituting a ceramic discharge vessel. However, it is known that niobium and tantalum are susceptible to corrosion by a metal halide. Therefore, it is desirable to form a conductive member with a metal selected from the group consisting of molybdenum, tungsten, rhenium and the alloys thereof, for improving the life of the conductive member. However, such metals, with high resistance against a metal halide, generally have a low thermal expansion coefficient. For example, alumina ceramics have a thermal expansion coefficient of $8\times10^{-6}K^{-1}$, molybdenum has that of $6\times10^{-6}K^{-1}$, and tungsten and rhenium have those of not more than $6\times10^{-6}K^{-1}$. In such a case, as described above, the inventive joined structure effectively reduces the stress due to the difference of the thermal expansion coefficients of the conductive member and the discharge vessel.

Molybdenum is suitably used for the invented structure for such advantages as its excellent resistance against a metal vapor, particularly a metal halide gas, and its high wettability to ceramics.

When molybdenum is used as a material of a conductive member, at least one of $La_2O_3$ and $CeO_2$ may preferably be added to molybdenum in a ratio of 0.1 to 2.0 weight percent as a total.

The main components of the metals constituting the conductive member and constituting the porous bone structure may preferably be the same and more preferably molybdenum. Such (main component) means that the component constitutes not lower than 60 weight percent of the metal.

The light-emitting vessel may preferably be made of a ceramic selected from the group consisting of alumina, magnesia, yttria, lanthania and zirconia, or the mixed ceramic thereof.

The shape of the conductive member is not particularly limited as long as the hollow portion is formed, and may preferably be a tube, cylinder or barrel. For maintaining a constant clearance between the conductive member (or porous bone structure) and discharge vessel during the joining process, the conductive member may preferably be cylindrical. The shape of a ceramic discharge vessel is not particularly limited, and includes a tube, a cylinder, a barrel or the like.

Preferably, an ionizable light-emitting substance is introduced into the inner space of the discharge vessel through the hollow portion of the conductive member. An electrode-system-supporting member is then inserted into the hollow portion of the conductive member to fix the electrode system in the inner space of the discharge vessel. The electrode-supporting and conductive members are sealed by laser welding or TIG welding. For example Nd/YAG laser may be used for laser welding.

In this case, a clearance between the electrode-supporting member and conductive members may preferably be between 30 to 150 $\mu$m in radial directions. The reason is as follows. If the clearance is too large, the light-emitting substance tends to accumulate in the clearance so that the unevenness of the property increases. If the clearance is too small, the electrode supporting system substantially contacts the conductive member and the thermal stress in the joining portion increases so that there is a tendency to induce fracture in the joining portion.

Figure 4:
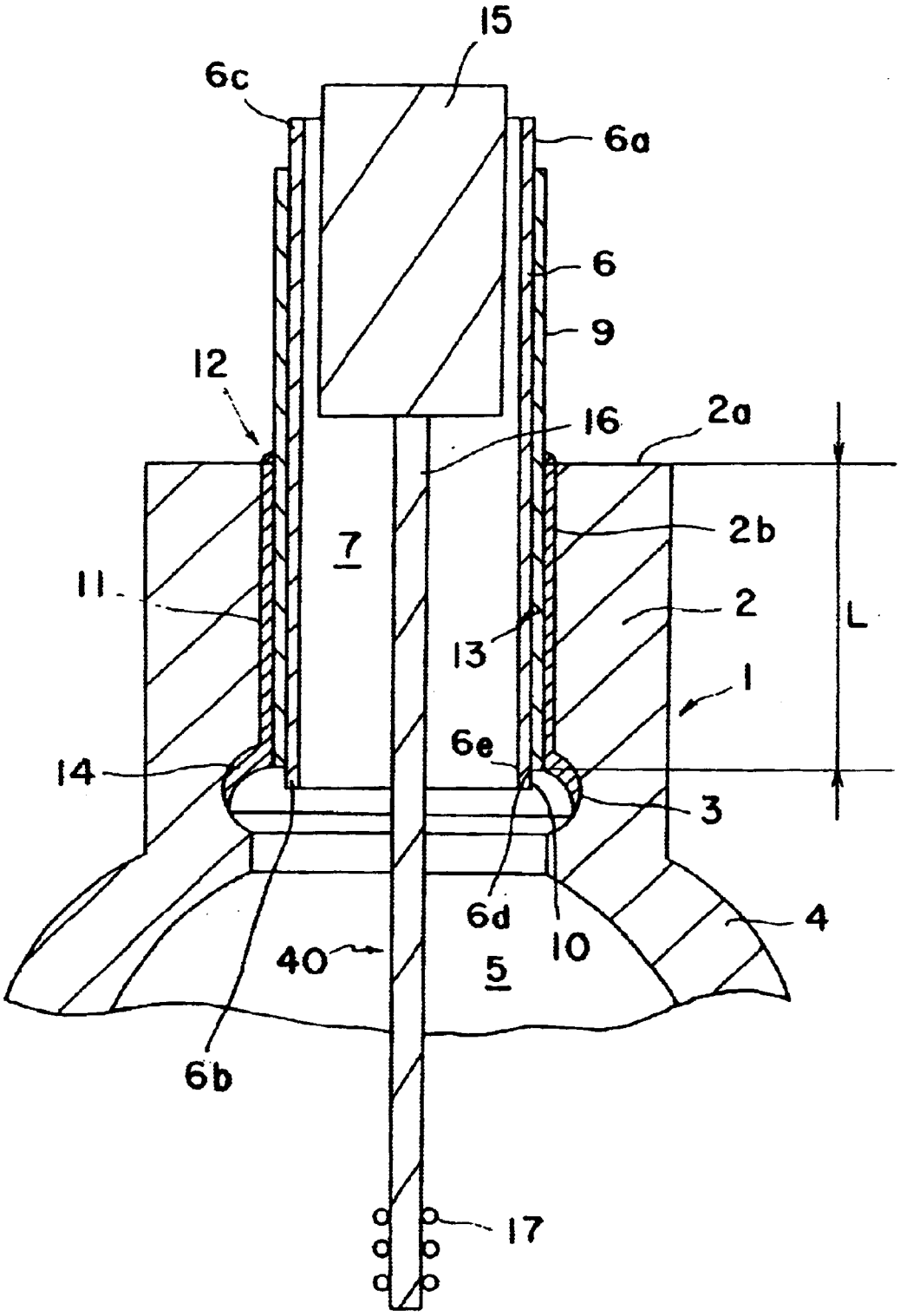
FIG. 4 shows an electrode system 17 and a supporting member 40 therefor inserted into an hollow portion 7 inside of the conductive member 6 shown in FIG. 3.
Figure 5:
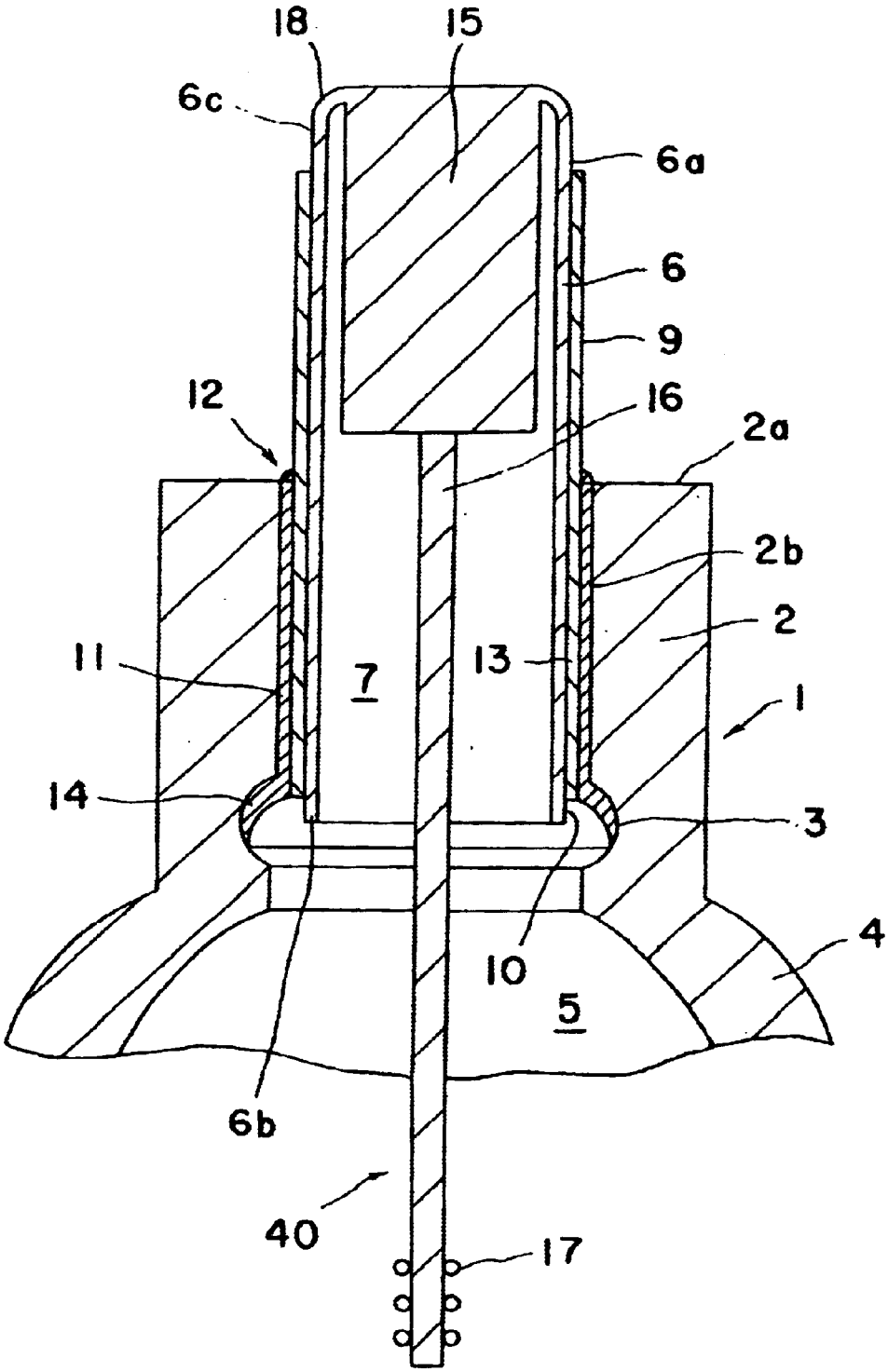
FIG. 5 is a longitudinal sectional view showing an assembly obtained by sealing the supporting and conductive members 40 and 6 with each other in the structure shown in FIG. 4.

As shown in FIG. 4, the supporting member 40 has an axis 16 supporting an electrode system 17 and preferably a sealing member 15 made of a metal. The electrode system 17 is contained in the inner space 5 of the discharge vessel and the sealing member 15 is inserted into the inside of the conductive member 6. The end part of the sealing member 15 is joined with the conductive member 6 by means of the above described process such as welding to form a sealed portion 18 as shown in FIG. 5. It is thereby possible to seal an ionizable light emitting substance and starter gas in the inner space of the discharge vessel so as to prevent the contact with outer atmosphere. It is also possible to supply electric power through the metal sealing member 15 to the electrode system 17.

Figure 6:
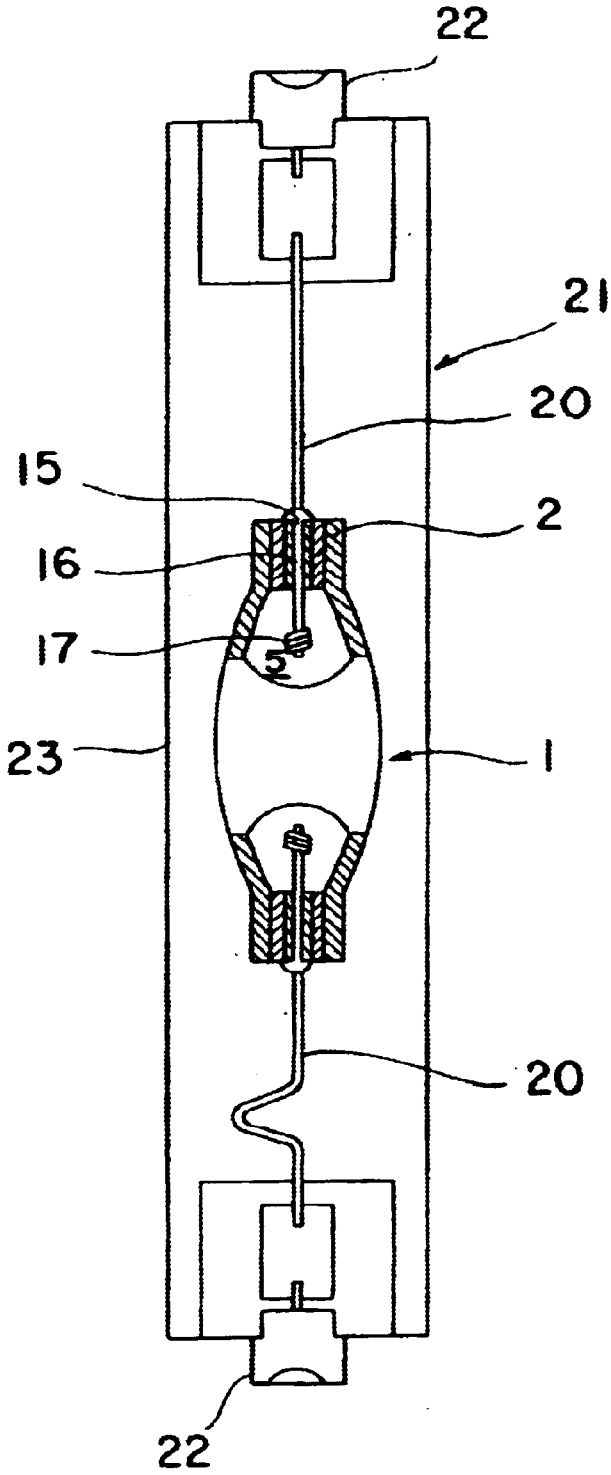
FIG. 6 is a diagram schematically showing the whole of a high pressure discharge lamp according to one example.

FIG. 6 is a diagram schematically showing an embodiment of a high pressure discharge lamp. A high pressure discharge lamp system 21 has an outer tube 23 generally made of a hard glass, in which a high pressure discharge lamp 1 is contained. The outer tube 23 has both ends sealed with ceramic caps 22. The conductive members are inserted into the openings of the end portions 2 of the vessel, respectively. Each sealing member 15 is inserted into and joined with each conductive member. An outer lead wire 20 is connected with each outer end of each sealing member 15.

It is not required that the recess be elongated continuously along the inner wall surface of the end portion or be ring-shaped in a cross section. Discontinuities or cuttings may be formed in the recess. In a preferred embodiment, the recess is extended continuously along the inner wall surface so that the recess is ring-shaped in a cross section. Such shape is advantageous for uniformly and evenly preventing the wetting of the end face and inner wall surface of the conductive member.

In a preferred embodiment, the profile 41 of the recess 3 is curved in a longitudinal section of the end portion (a section shown in FIG. 1). The advantages are as follows. When joining material is supplied and stored in the recess 3, the curved profile may be useful for preventing or reducing the concentration of stress in the joining material in the recess to prevent crack formation in the joining material. In the present embodiment, the profile is curved. This means that the gradient of the profile is smoothly changed on the viewpoint of infinitesimal calculus. Typically, the curved line may be an arc of a complete circle or an ellipse, and may further be a parabolic curve, sine (cosine) curve, and a quadric, cubic, quartic or the like.

Figure 8:
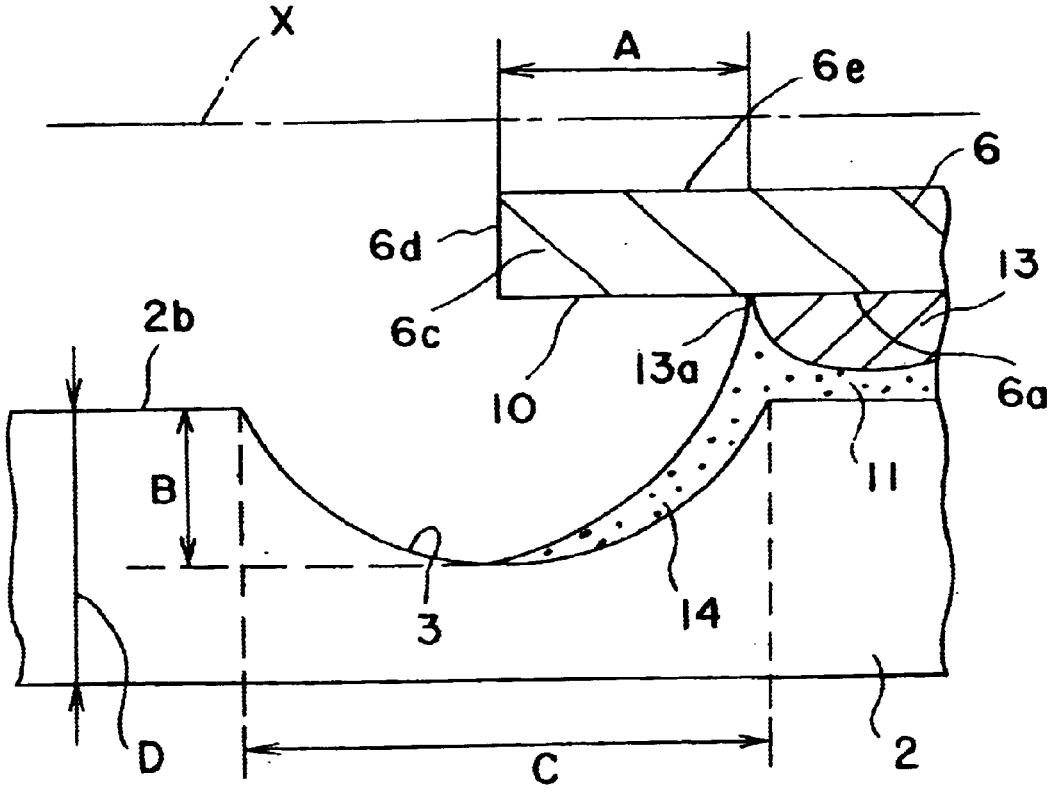
FIG. 8 is an enlarged view showing a preferred example of an end structure according to the assembly of the present invention.

In a preferred embodiment, for example as shown in 14 in FIG. 8, the material constituting the joining layer is present in the recess. Particularly preferably, the material forming the intermediate layer or impregnated phase of the joining layer, such as a glass or ceramics, is present in the recess.

The preferred relative position of the conductive member, recess and porous bone structure will be described. In a preferred embodiment, the inner end of the conductive member is present inside of the recess. In this case, the joining material may be easily flown and absorbed into the recess before wetting the end face of the conductive member, so that the advantages of the present invention are farther improved. For example, in the example of FIG. 8, the inner end face 6*d* of the conductive member 6 is present inside of the ring shaped recess 3 in a cross section. The material for the intermediate layer 11 may be easily flown toward the inner wall surface 3 of the recess to prevent the wetting of the end face 6*d*.

Further, in a preferred embodiment, an exposed region without the joining layer is present on the outer surface of the end portion of the conductive member. For example as shown in FIG. 8, the end of the joining layer 12 (the end 13*a* of the bone structure 13) is distant from the end face 6*d* at a specified distance, so that an exposed region 10 is formed between the end 13*a* of the joining layer and the end face 6*d*.

Figure 9:
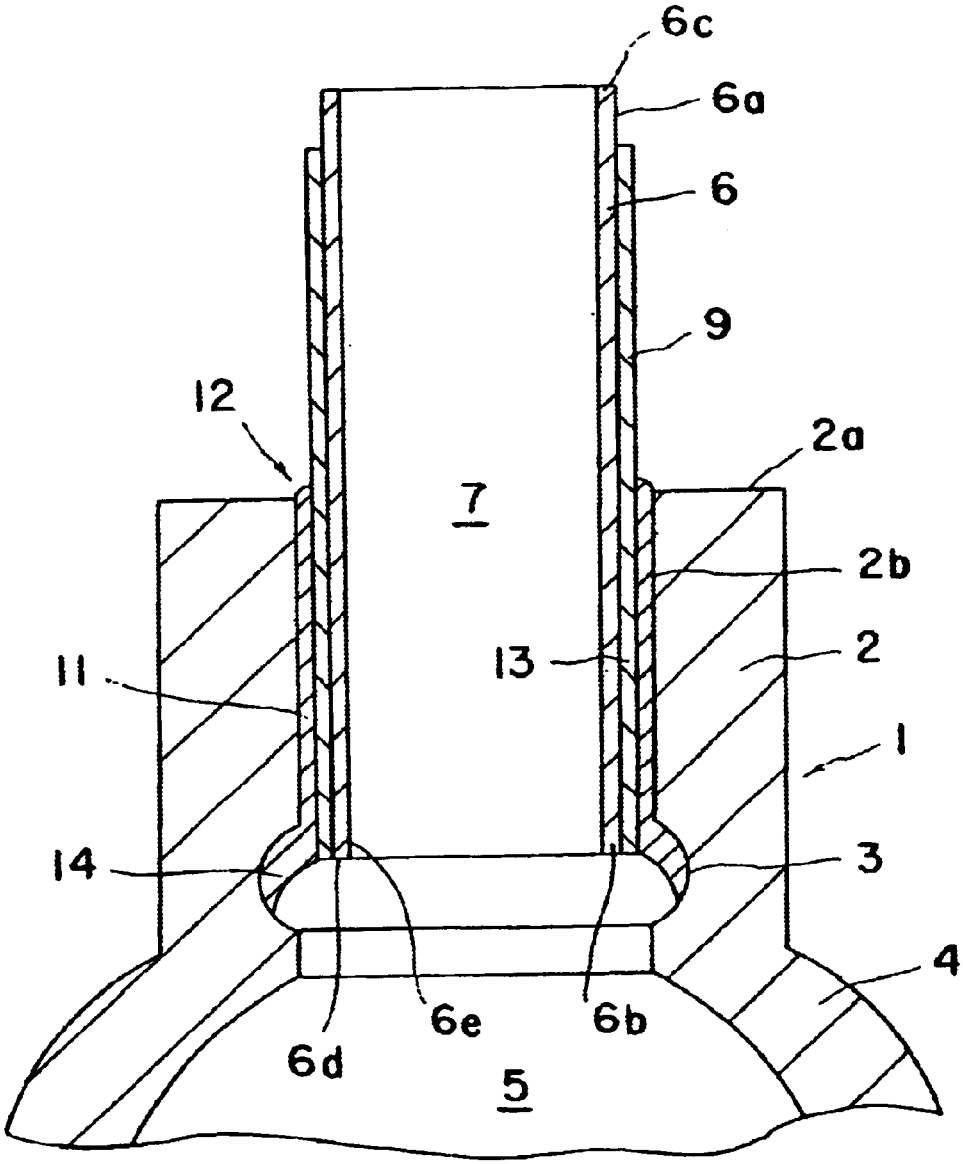
FIG. 9 is a longitudinal sectional view showing an end structure according to one example of the present invention.

When the exposed region is not provided between the end of the joining layer 12 and the end face 6*d* of the conductive member 6 as shown in FIG. 9, however, the advantages of the recess 3 may be obtained and thus within the scope of the present invention. When the exposed region is provided, the following effects may be further obtained.

The conductive members may be inserted into both end portions of the discharge vessel, respectively, and joining layers may be provided between the inner wall surfaces of the end portions and the outer surfaces of the conductive members, respectively. In this case, the concentricity of the conductive members in one and the other end portions may preferably be smaller. If the central axes of the conductive members in both end portions are substantially distant, the discharge property is deviated and deteriorated. The concentricity may thus preferably be not larger than 50 $\mu$m.

Concentricity may be measured as follows. One pin gauge is inserted into the conductive member in one end portion to measure a diameter øa. The other pin gauge is inserted into the conductive member in the other end portion to measure a diameter øb. A concentricity is defined by øa–øb.

Figure 10:
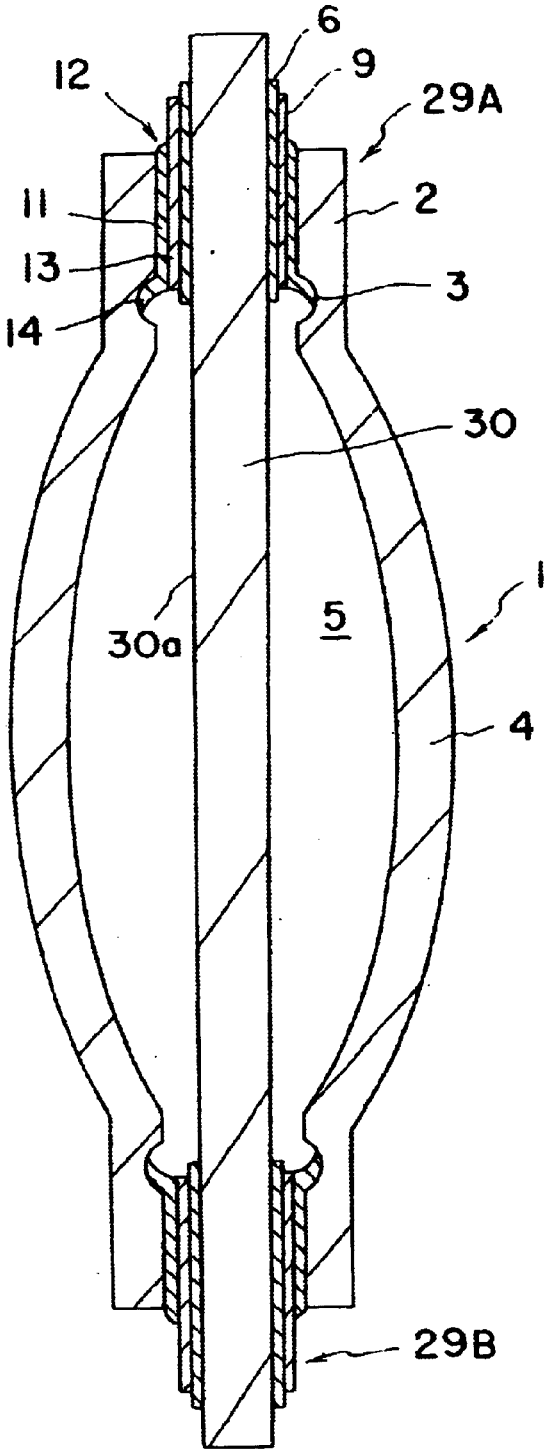
FIG. 10 shows an assembly obtained by inserting means 30 for adjusting a concentricity into the hollow portion of the conductive member 6, in the end portions 29A and 29B of the vessel 1.

It is necessary to arrange one and the other end portions in parallel with each other and to fix the conductive members so that the distance between the central axes of the conductive members is lowered, for reducing the concentricity. Such arrangement and fixing may be, however, difficult in an actual manufacturing process. Generally, it is preferred to insert a common concentricity adjusting means into the conductive members in one and the other end portions and to fix the conductive members from the inside through the common adjusting means. It is thus possible to adjust the central axes of the conductive members in both end portions. The adjusting means may typically be a straight rod or tube. For example as shown in FIG. 10, one common rod 30 is inserted in the conductive members 6 in one and the other end portions 29A and 29B to fix the respective conductive members 6 from the inside. The central axes of the conductive members in end portions are thus adjusted. Thereafter, the joining material is flown into the clearance between the conductive member and end portion of the vessel to form the joining layer 12. When the common concentricity-adjusting means 30 is inserted into both conductive members in the end portions at this stage, however, the inner surface of the conductive member may be occasionally wetted even when the recess 3 is formed.

Figure 11:
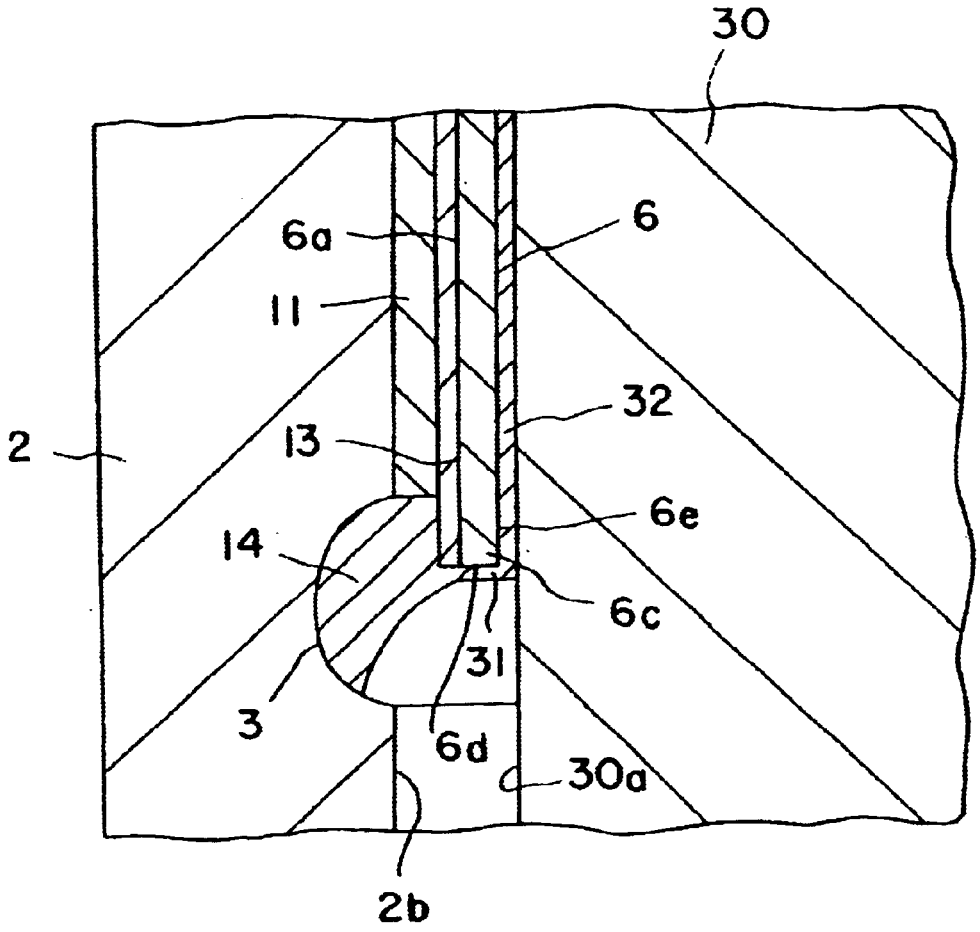
FIG. 11 is an enlarged view showing molten joining material absorbed into a clearance between the outer surface 30*a* of the means 30 and inner wall surface 6*e* of the conductive member 6.

The inventors have researched the cause and reached the following discovery. FIG. 11 is an enlarged view of the recess 3 and its proximity shown in FIG. 10. That is, a rod 30 is inserted into the conductive member 6 for adjusting the central axes of a pair of conductive members. It is therefore necessary to reduce a gap between the outer surface 30*a* of the rod 30 and inner surface 6*e* of the member 6. If the gap is too large, the rod may not properly function for adjusting the concentricity of the conductive members 6 with a sufficiently small error. On this viewpoint, the gap may preferably be not larger than 50 $\mu$m.

As the gap is made smaller as described above, the molten material may be easily absorbed into the gap due to so-called capillary phenomenon. Consequently, joining material 31 may be left on the end face 6*d* of the conductive member 6 and joining material 32 may be left in a gap between the inner wall surface 6*e* and the outer surface 30*a* of the rod 30. It is thus difficult to remove the inserted rod due to the residual joining material to reduce the production yield.

Figure 12:
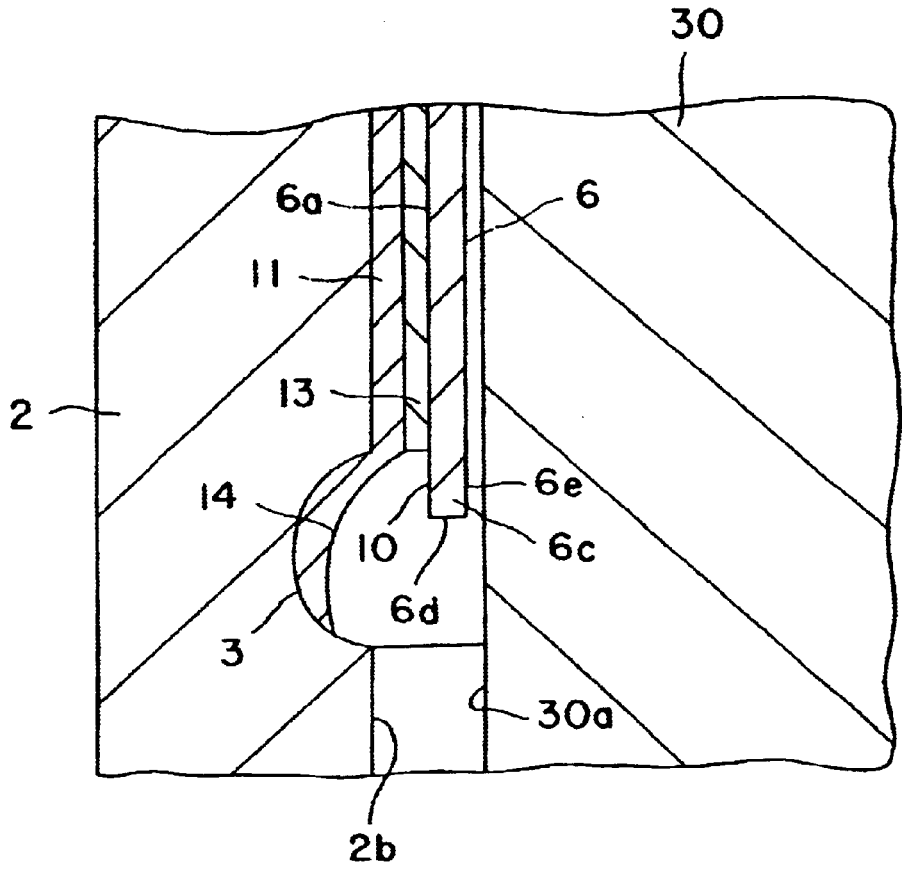
FIG. 12 is an enlarged view showing an end portion having the conductive member 6 and an exposed region 10 provided on the outer surface according to a preferred embodiment of the present invention.

The exposed region 10 described above shown in FIG. 12, in combination with the recess 3 absorbing the joining material, are effective for preventing the contact of the joining material onto the end face 6*d* of the conductive member 6. It is thus possible to prevent the contact of the molten material onto the end face 6*d*, even when capillary phenomenon may be easily induced in a gap between the rod 30 and the conductive member 6. The absorption of the molten material into the gap may be thus prevented In a preferred embodiment, the exposed region 10 has a length "A" (see FIG. 8) of not shorter than 0.3 mm in the direction of the central axis of the discharge vessel. It is thereby possible to further reduce the absorption of the molten material due to capillary phenomenon. "A" may preferably be not longer than ¼ of a length "L" (see FIG. 4) of the joining layer 4. It is thereby possible to further improve the reliability, especially of air-tightness, of the joining layer.

In a preferred embodiment, the depth "B" of the recess (see FIG. 8) is not smaller than 1/10 of the thickness "D" of the end portion. It is thereby possible to further improve the above effects of absorbing the molten material. "B" may preferably be not larger than 3/10 of "D" for preventing the reduction of strength near the recess.

As shown in FIG. 8, the width "C" of the recess 3 may preferably be not larger than ¼ of the length "L" (see FIG. 4) of the joining layer. It is thereby possible to further improve the above effects of absorbing the molten material. "C" may preferably be not larger than ½ of "L" for preventing storage of a corrosive substance such as a halide in the recess so that the corrosion starting from the recess 3 with the stored corrosive substance may be prevented.

Preferred process for producing high pressure discharge lamps according to the invention will be described below. A ceramic discharge vessel is shaped, dewaxed and calcined to obtain a calcined body of the discharge vessel. A pre-sintered body of the sealing member is inserted into the end portion of the resulting calcined body, set at a predetermined position and finish-sintered under reducing atmosphere of a dew point of −15 to 15° C. at a temperature of 1600 to 1900° C. to obtain a ceramic discharge vessel 1.

Metal powder is formulated, crushed, dried, and milled with an added binder such as ethyl cellulose, acrylic resin or the like, to obtain a paste, which is then applied onto the outer surface 6*a* of the conductive member 6 and dried at a temperature of 20 to 60° C. The resulting calcined body is sintered under reducing or inert atmosphere or vacuum of a dew point of 20 to 50° C. at a temperature of 1200 to 1700° C. to obtain a porous bone structure 9.

Also, powder or frit is pre-formulated to a predetermined ceramic composition, crushed, granulated with an added binder such as polyvinyl alcohol or the like, press-molded and dewaxed to obtain molded body. Alternatively, powder or frit for a ceramic is molten and solidified to obtain a solid, which is then crushed, granulated with added binder, press-molded and dewaxed to obtain a molded body. In this case, it is preferred to add 3 to 5 weight percent of a binder to the powder, to press-mold at a pressure of 1 to 5 ton, and to dewax.

Such discharge vessel, conductive member, porous bone structure and molded material are assembled and heated to a temperature of 1000 to 1600° C. under dry and non-oxidizing atmosphere.

Alternatively, paste of ceramic or glass composition may be applied on and around the conductive member 6 and bone structure 9. In this case, the ceramic or glass composition is formulated, crushed, dried and kneaded with ethyl cellulose or an acrylic resin or the like to produce a paste. The paste is then applied on a predetermined position and sintered at a temperature of 1600 to 1900° C. under non-oxidizing, dry and reducing atmosphere. It may be thus possible to eliminate the necessity of the dewaxing of the ceramic composition for obtaining the molded body.

The assembly for a high pressure discharge lamp shown in FIG. 5 was obtained according to the procedure described referring to FIGS. 1 to 5 and the above described manufacturing process. A ceramic discharge vessel is formed of an alumina porcelain and the conductive member 6 is a pipe made of molybdenum metal. Molybdenum powder with a mean particle diameter of 3 $\mu$m was used and ethyl cellulose is used as a binder for producing the bone structure 9. The molybdenum powder had a tap density of 2.9 g/cc.

A straight rod 30 was inserted through both conductive members 6 at both ends of the vessel as shown in FIG. 10. The compositions of the impregnated phase and intermediate layer were 10 weight percent of dysprosium oxide, 45 weight percent of aluminum oxide and 45 weight percent of aluminum nitride. The mixture was shaped to obtain a ring-shaped body which is then dewaxed at 700° C. in atmosphere. The thus obtained ring-shaped body was then set and heated at 1800° C. under dry and reducing atmosphere so that the mixture was molten and impregnated into the pores of the bone structure 9 and then cooled.

In the thus obtained assembly for a high pressure discharge lamp, the end face or inner wall surface of the conductive member 6 is not wetted with the molten material. The assembly also maintained excellent air-tightness after thermal cycles. The concentricity ø was 40 $\mu$m, "A" was 0.5 mm, "B" was 0.15 mm, "C" was 1.0 mm and "D" was 1.0 mm.

As described above, the present invention provides a novel high pressure discharge lamp utilizing a ceramic discharge vessel in which a conductive member with a hollow portion formed is inserted into the opening of end portion of the vessel. The adhesion or residue of joining material onto the end face or inner surface of the conductive member may be thus prevented The present invention has been explained referring to the preferred embodiments. The invention is, however, not limited to the illustrated embodiments which are given by way of examples only, and may be carried out in various modes without departing from the scope of the invention.

What is claimed is:

1. An assembly for a high pressure discharge lamp: said assembly comprising;

a ceramic discharge vessel having end portions and an inner space formed therein to be filled with an ionizable light emitting substance and a starter gas, said end portion having an inner wall surface facing an opening formed in said end portion;

a conductive member having an outer surface and inner surface facing a hollow portion formed therein, said conductive member being inserted in said opening; and a joining layer joining said inner wall surface of said end portion and said outer surface of said conductive member, wherein a recess facing said opening is formed in said end portion, said recess extending circumferentially with respect to the central axis of said ceramic discharge vessel.

2. The assembly of claim 1, wherein said recess is substantially ring-shaped in a cross section of said end portion.

3. The assembly of claim 1, wherein said recess has a curved profile in a longitudinal section of said end portion.

4. The assembly of claim 1, wherein a material constituting said joining layer is present in said recess.

5. The assembly of claim 1, wherein said conductive member has an end face positioned in said opening of said end portion and inside of said recess.

6. The assembly of claim 1, wherein an exposed region without said joining layer is provided on said outer surface of said conductive member and in said opening.

7. The assembly of claim 6, wherein a length "A" of said exposed region in the direction of said central axis is not shorter than 0.3 mm and not longer than ¼ of a length "L" of said joining layer in the direction of said central axis.

8. The assembly of claim 1, wherein a length "C" of said recess in the direction of said central axis is not shorter than ¼ and not longer than ½ of a length "L" of said joining layer in the direction of said central axis.

9. The assembly of claim 1, wherein said joining layer comprises an inner layer in the side of said conductive member and an intermediate layer between said inner layer and said discharge vessel, said inner layer comprises a porous bone structure with open pores and made of a sintered body of metal powder and impregnated phase composed of a ceramic or glass impregnated into said open pores, and said intermediate layer is composed of a ceramic or glass.

10. The assembly of claim 9, wherein a ceramic or glass is present in said recess.

11. The assembly of claim 1, wherein said recess has a depth "B" not smaller than 1/10 and not larger than 3/10 of a thickness "D" of said end portion.

12. The assembly of claim 1, wherein said conductive members are inserted into said end potions, respectively, said joining layers are provided between said inner wall surfaces of said end portions and said outer surfaces of said conductive members, respectively, said recesses are formed in said end portions, respectively, and said conductive members in one and the other of said end portions are adjusted at a concentricity of not larger than 50 $\mu$m.

13. A high pressure discharge lamp comprising said assembly of claim 1 and an electrode system fixed in said inner space.

14. A ceramic discharge vessel for a high pressure discharge lamp, said discharge vessel having end portions and an inner space formed therein to be filled with an ionizable light emitting substance and a starter gas, said end portion having an inner wall surface facing an opening being formed in said end portion, wherein a recess facing said opening is formed in said end portion and extends circumferentially with respect to the central axis of said ceramic discharge vessel.

15. The discharge vessel of claim 14, wherein said recess is substantially ring shaped in a cross section of said end portion.

16. The discharge vessel of claim 14, wherein said recess has a curved profile in a longitudinal section of said end portion.

17. The discharge vessel of claim 14, wherein said recess has a depth "B" not smaller than 1/10 and not larger than 3/10 of a thickness "D" of said end portion.

* * * * *